US008230921B2

(12) United States Patent
Stine et al.

(10) Patent No.: US 8,230,921 B2
(45) Date of Patent: Jul. 31, 2012

(54) OIL RECOVERY BY IN-SITU CRACKING AND HYDROGENATION

(75) Inventors: Laurence O. Stine, Western Springs, IL (US); Paul T. Barger, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 491 days.

(21) Appl. No.: 12/241,707

(22) Filed: Sep. 30, 2008

(65) Prior Publication Data

US 2010/0078172 A1 Apr. 1, 2010

(51) Int. Cl.
*E21B 43/25* (2006.01)
*E21B 43/24* (2006.01)
*E21B 36/00* (2006.01)

(52) U.S. Cl. ..... 166/260; 166/261; 166/302

(58) Field of Classification Search ..... None
See application file for complete search history.

(56) References Cited

U.S. PATENT DOCUMENTS

| | | | |
|---|---|---|---|
| 2,857,002 | A | 10/1958 | Pevere et al. |
| 3,084,919 | A | 4/1963 | Slater |
| 3,208,514 | A | 9/1965 | Dew et al. |
| 3,766,982 | A | 10/1973 | Justheim |
| 3,982,592 | A | 9/1976 | Hamrick et al. |
| 3,989,107 | A | 11/1976 | Fisher et al. |
| 4,050,515 | A | 9/1977 | Hamrick et al. |
| 4,409,397 | A | 10/1983 | Paxson |
| 4,444,257 | A | 4/1984 | Stine |
| 4,448,251 | A | 5/1984 | Stine |
| 4,485,869 | A | 12/1984 | Sresty et al. |
| 4,597,441 | A | 7/1986 | Ware et al. |
| 4,691,771 | A | 9/1987 | Ware et al. |
| 4,706,751 | A | 11/1987 | Gondouin |
| 4,803,184 | A | 2/1989 | Long et al. |
| 5,099,918 | A | 3/1992 | Bridges et al. |
| 5,145,003 | A | 9/1992 | Duerksen |
| 5,322,617 | A | 6/1994 | de Bruijn et al. |
| 5,339,897 | A | 8/1994 | Leaute |
| 6,016,868 | A | 1/2000 | Gregoli et al. |

*Primary Examiner* — Angela M DiTrani
(74) *Attorney, Agent, or Firm* — James C Paschall

(57) ABSTRACT

Enhanced recovery of crude oil from an oil well is provided by in-situ cracking of an oxygenated organic compound to form hydrogen. The crude oil is then hydrogenated and hydrogenation reaction products and crude oil are recovered from the oil well.

20 Claims, 1 Drawing Sheet

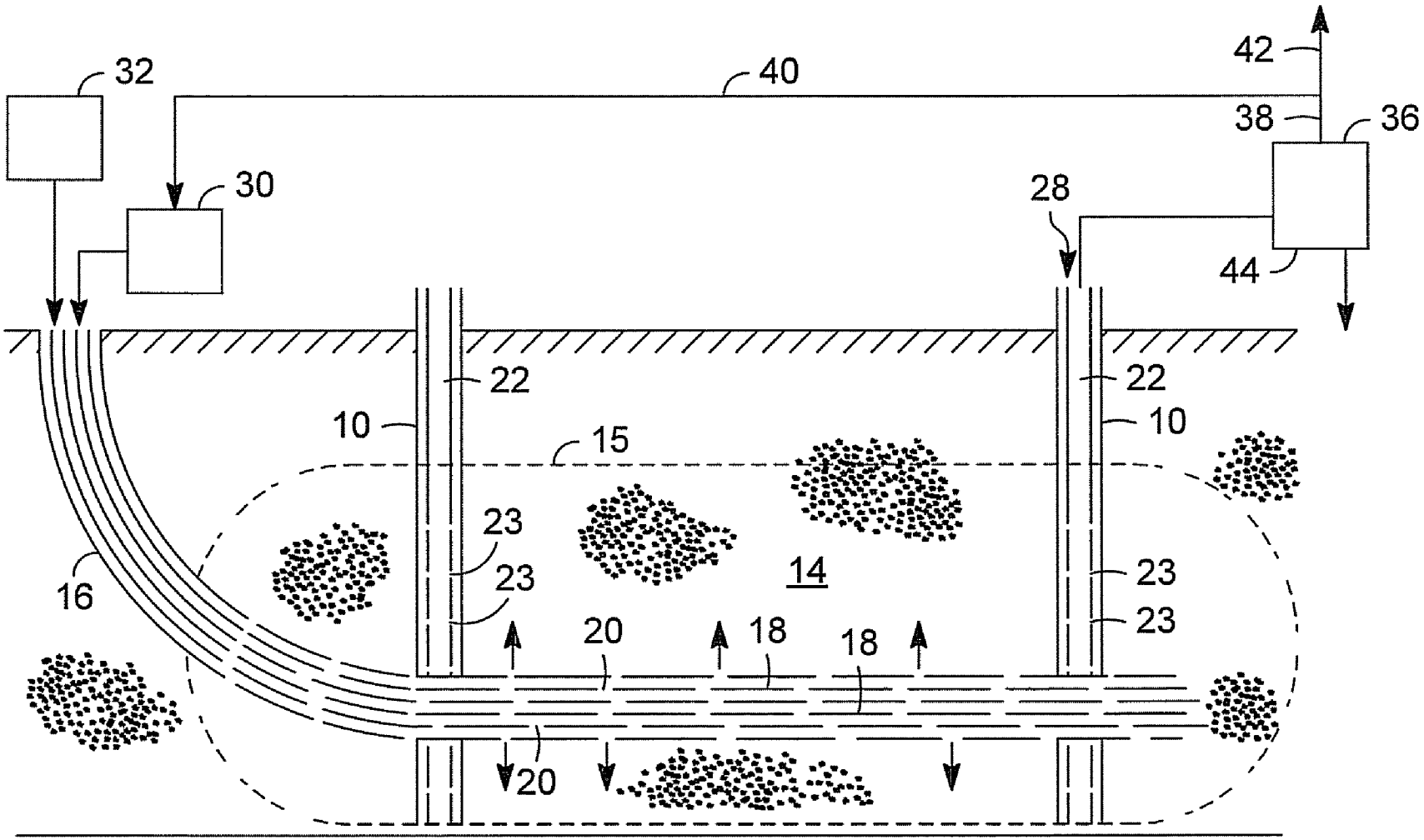
36
42
38
44
40
28
22
10
23
23
18
14
18
15
20
20
22
23
23
10
30
32
16

OIL RECOVERY BY IN-SITU CRACKING AND HYDROGENATION

BACKGROUND OF THE INVENTION (1) Field of the Invention

This invention concerns methods for enhancing the recovery of crude oil from an oil well by in-situ cracking and/or steam reforming of an oxygenated organic compound to form hydrogen followed by hydrogenation and by recovery of hydrogenation reaction products and crude oil.

(2) Description of the Art

Many oil deposits exist which contain heavy oil that is difficult to recover from underground. The Orinoco Tar Belt in Venezuela, the Alberta Tar Sands in Canada and the heavy California oils around Bakersfield and the Santa Maria basin are examples of such difficult to recover oils. The Orinoco Tar Belt in particular is estimated to include up to a trillion barrels of oil of which only a few percentages can be produced using current production methods.

Some difficult to recover oils are under production with enhanced oil recovery methods. Examples of useful enhanced oil recovery methods include steam flooding, $CO_2$ injection and water floods. U.S. Pat. Nos. 4,050,515, 4,444,257 and 4,448,251 disclose enhanced oil recovery methods that employ in situ hydrogenation. However, production of difficult to recover oils is only slightly improved by many of these enhanced oil recovery techniques. There is clearly a need, therefore, for new techniques for improving the production of difficult to recover oils.

SUMMARY OF THE INVENTION

This invention concerns methods for improving the production of oil from difficult to recover oil fields by cracking and then hydrogenation of the difficult to recover oil in-situ before oil production to modify properties of the oil such as molecular weight, boiling point and so forth in order to enhance the production of the difficult to produce oils.

One aspect of this invention, therefore, is a method for the in-situ hydrogenation and recovery of crude oil which method comprises: establishing an in-situ reaction zone within a crude oil reservoir; heating at least a portion of the in-situ reaction zone to a temperature of from about 150° C. to about 500° C.; introducing an oxygenated organic compound and optionally water into the in-situ reaction zone; reacting the oxygenated organic compound in the in-situ reaction zone to form a reaction product including hydrogen and optionally $CO_2$; hydrogenating crude oil in the in-situ reaction zone in the presence of hydrogen from the reaction product to form a hydrogenation reaction product; and recovering a hydrocarbon material from the crude oil reservoir including at least some of the hydrogenation reaction product and crude oil.

DESCRIPTION OF THE FIGURES

FIG. 1 is an elevation view of an embodiment of a method of the present invention.

DETAILED DESCRIPTION OF THE INVENTION

The present invention relates to methods for enhancing oil well production rates by in-situ cracking and/or steam reforming and dehydrogenation. The term "oil well production" refers herein generally to the recovery of naturally occurring liquid or solid hydrocarbons such as crude oil from underground oil containing geological formations. The term should be interpreted broadly herein to include the removal of hydrocarbons from any type of underground hydrocarbon containing structures such as tar sands as well as heavy oil deposits in locations discussed above such as Venezuela and Bakersfield, Calif.

Preferred embodiments of the present invention will be discussed with reference to FIG. 1. FIG. 1 shows a pair of spaced-apart production wells 10 which penetrate the earth to a viscous petroleum or tar sand formation 14. Production wells 10 include perforated portions 23 within in-situ reaction zone 15 defined by the dashed line. At least one well 16 is directed into in-situ reaction zone 15 in order to inject liquid, vapor and gaseous materials into the in-situ reaction zone. The number and location of well(s) 16 with respect to in-situ reaction zone 15 will vary depending upon many factors including, but not limited to the size of the in-situ reaction zone, the depth of the in-situ reaction zone, the type of materials being injected into the in-situ reaction zone and so forth.

Each well 16 will typically include one or more hollow tubular members 18. Each hollow tubular member 18 is preferably steel and may be made up of one continuous piece of tubing or many tubular members attached to one another at connecting joints. The hollow tubular members 18 include perforations 20 which provide a continuous, uninterrupted flow path through well 16 into in-situ reaction zone 15 within viscous petroleum-containing formation 14.

Production wells 10 are cased by a suitable casing string 22. Casing 22 includes slots or perforations 23 in the production zone which will generally be defined by the in-situ reaction zone but may be larger or smaller. The upper end of the casing string 26 is closed by a wellhead 28. An apparatus for lifting petroleum from the interior of production well 12 is provided at wellhead 28. For example, a pump can be used to lift petroleum through a well 10 to the surface.

The methods of this invention are facilitated or can be enhanced by injecting on or more types of materials into in-situ reaction zone 15. Materials that can be injected into in-situ reaction zone 15 include but are not limited to heating materials, catalyst materials, oxygenated organic compound materials and recycle materials. Useful injectable materials will typically be held one or more containers such as containers 30 and 32 shown in FIG. 1. The containers 30 and 32 may be vessels, they may be steam generators, they may be storage tanks, they may be drums and so forth. What is important is that one or more injectable materials are directed from containers 30 and 32 and dispersed throughout in-situ reaction zone 15 via perforations 20 in tubular members 18.

In operation, in-situ reaction zone 15 is heated to and maintained at a temperature of from about 150° C. to about 500° C., the temperature necessary to initiate and possibly sustain the cracking and hydrogenation reactions that are discussed below. The in-situ reaction zone may be heated to the desired temperature by a variety of methods including, but not limited to, injecting superheated steam or heated hydrocarbons into the in-situ reaction zone through tubular member 18. Alternatively, an oxidizing agent may be injected into the in-situ reaction zone and oxidized at oxidation conditions to heat in in-situ reaction zone 15 to the desired temperature. One example of an oxidizing agent is oxygen or air which can be injected into the in-situ reaction zone through tubular member 18 to initiate a combustion reaction that heats the in-situ reaction zone. Steam or water can be injected into in-situ reaction zone 15 with the oxygen in order to minimize hydrocarbon coking during the oxidization reaction. Other methods for heating oil well production zones which can be used in the methods of the present invention include are disclosed for example in U.S. Pat. Nos. 3,989,107, 4,485,869, 4,691,771, and 5,099,918 the specifications of each of which are incorporated herein by reference.

Once in-situ reaction zone 15 is heated to the desired temperature, the subsequent hydrogenation reaction may be capable of maintaining the in-situ reaction zone at the desired reaction temperatures without injecting addition heating materials into the in-situ reaction zone. Therefore, in one embodiment of the invention, the injection of heating materials into the reaction zone is halted once the hydrogenation reaction is initiated. Alternatively, the heating materials may be injected continuously or intermittently to the in-situ reaction zone 15 as necessary to maintain the in-situ reaction zone temperature at the desired level.

Once the in-situ reaction zone 15 is at the desired temperature, one or more oxygenated organic compounds are injected into in-situ reaction zone in order to initiate the cracking reaction. The oxygenated organic compounds may be selected from any hydrocarbon or other organic compound that includes oxygen and that are capable of cracking and/or steam reforming at in-situ reaction zone temperature and pressure conditions. The oxygenated organic compounds will crack at cracking conditions to form hydrogen and other cracking products including $CO_2$. Broadly speaking, the oxygenated organic compounds may include, but are not limited to ethers, ketones, alcohols, aldehydes, glycols, carbohydrates and combinations thereof. Preferred carbohydrates include fructose, sucrose and glucose and mixtures thereof among others. Preferred organic compounds are also those that have a carbon:oxygen mole ratio of about 1. Moreover, preferred organic hydrocarbon compounds will include from 1 to 6 carbon atoms. More preferably, the oxygenated organic compounds are alcohols and more preferably $C_1$-$C_6$ alcohols. Most preferably, the oxygenated organic compounds are methanol, ethanol, and mixtures thereof.

Water may be optionally added to the in-situ reaction zone to promote steam reforming. The water may be added in the form of liquid water or steam. In addition, the water or steam may be added continuously or intermittently to the in-situ reaction zone as needed or the reaction zone may be flooded with water prior to initiating the cracking/steam reforming reactions.

The hydrogen product of the cracking/reforming reaction is necessary to initiate the hydrogenation reaction. In the presence of the cracking/reforming product, the crude oil is hydrogenated to enhance its producibility by at least one of a variety of methods including but not limited to by reducing the molecular weight of crude oil molecules, by improving the crude oil solubility and/or by lowering the viscosity of at least some of the crude oil molecules. Hydrogenation and thermal cracking also promotes lowering of the oil viscosity and thus, water is separated from the produced crude oil easier making the processing of the recovered oil more economical.

Using oxygenated organic compounds as a cracking reaction feed as discussed above provides several advantages over injecting hydrogen directly into in-situ reaction zone 15. One advantage is that the oxygenated organic compounds are easier to store and inject into in-situ reaction zone 15 because they are in liquid or molten form when injected into in-situ reaction zone 15 and preferably they are liquids at standard temperatures and pressures. Another advantage of using the oxygenated organic compounds as cracking reaction feeds is the resulting production of carbon dioxide which is a well known hydrocarbon solvent at high pressures. Therefore, not only do oxygenated organic compounds crack to produce hydrogen that is available for subsequent crude oil hydrogenation. The production of carbon dioxide as a cracking reaction product can also improve the production of crude oil from the in-situ reaction zone.

The crude oil recovered from the in-situ reaction zone will include hydrogenated crude oil that is a hydrogenation reaction product. It will include unreacted crude oil and it will include cracking reaction products as well as unreacted feed materials. Therefore, crude oil produced from wells 10 can be directed into a separator 36 where an overhead stream 38 including unreacted hydrogen, unreacted oxygenated organic compounds, carbon dioxide and other light materials can be recovered and either injected via recycle stream 40 back into the in-situ reaction zone or recovered in line 42. A liquid crude oil fraction will generally be recovered from separator 36 as a bottom stream in line 44.

The cracking and hydrogenation reactions occurring in the in-situ hydrocarbon reaction zone can be promoted by catalytic materials that are naturally present in the in-situ reaction zone and/or in the crude oil or both. In addition, cracking and hydrogenation catalysts can be injected into the in-situ reaction zone either prior to or during the cracking and hydrogenation reactions in order to further promote the efficiency of the cracking and hydrogenation reactions.

Depending on the resulting cracking/steam reforming and hydrogenation reaction rates, one or more catalysts of the type generally known to those familiar with hydrogenation, steam reforming and thermal cracking processes, and preferably metal-containing catalysts, may be injected through slotted tubular member 18 into in-situ reaction zone 15 to further enhance the reaction rates. Metal containing catalysts may include for example Ni, Mo, Co, Ru, V, Pt, Pd, Fe, Cu, Zn, mixtures thereof and so forth. One or more catalyst may be injected either before cracking and hydrogenation or during cracking and hydrogenation, or both, in a continuous or intermittent pattern. The catalyst can be a gaseous form, liquid solution or slurry. Preferably, the catalyst will be either a liquid solution or slurry form.

The invention claimed is:

1. A method for the in-situ hydrogenation and recovery of crude oil which method comprises:

(a) establishing an in-situ reaction zone within a crude oil reservoir;

(b) heating at least a portion of the in-situ reaction zone to a temperature of from about 150° C. to about 500° C.;

(c) injecting an oxygenated organic hydrocarbon compound into the in-situ reaction zone;

(d) reacting the oxygenated organic hydrocarbon compound in the in-situ reaction zone to produce hydrogen and other cracking products;

(e) hydrogenating crude oil in the in-situ reaction zone in the presence of the hydrogen produced to form a hydrogenation reaction product; and (f) recovering a hydrocarbon material from the crude oil reservoir including at least some of the hydrogenation reaction product and crude oil.

2. The method of claim 1 wherein the oxygenated organic hydrocarbon compound is selected from the group of compounds consisting of ethers, ketones, alcohols, aldehydes, glycols, carbohydrates and mixtures thereof.

3. The method of claim 1 wherein the oxygenated organic hydrocarbon compound includes at least one alcohol.

4. The method of claim 1 wherein the oxygenated organic hydrocarbon compound includes a $C_1$-$C_6$ alcohol.

5. The method of claim 4 wherein the $C_1$-$C_6$ alcohol is selected from the group consisting of methanol, ethanol and a mixture thereof.

6. The method of claim 1 wherein the oxygenated organic hydrocarbon compound is a carbohydrate.

7. The method of claim 6 wherein the carbohydrate is selected from glucose, sucrose, fructose and combinations thereof.

8. The method of claim 1 wherein the oxygenated organic hydrocarbon compound is a glycol.

9. The method of claim 1 wherein the in-situ reaction zone is heated with steam or hot oil or a combination thereof.

10. The method of claim 1 wherein the in-situ reaction zone is heated by injecting an oxidizing agent into the in-situ reaction zone to initiate an oxidation reaction.

11. The method of claim 10 wherein the oxidizing agent is oxygen.

12. The method of claim 1 wherein a catalyst selected from the group consisting of a cracking catalyst, a hydrogenation catalyst, a steam reforming catalyst and combinations thereof are injected into the in-situ reaction zone.

13. The method of claim 1 wherein the hydrocarbon material recovered in step (f) are directed to a separator to form at least an overhead product and a bottom product and wherein at least a portion of the overhead product is injected into the in-situ reaction zone.

14. The method of claim 13 wherein the overhead product includes at least one component selected from the group consisting of hydrogen, carbon dioxide, and an oxygenated organic compound.

15. The method of claim 1 wherein heating step (b) is halted after hydrogenating step (f) is initiated.

16. The method of claim 1 wherein the reacting step (d) also produces $CO_2$.

17. A method for the in-situ hydrogenation and recovery of crude oil which method comprises:

(a) establishing an in-situ reaction zone within a crude oil reservoir;

(b) heating at least a portion of the in-situ reaction zone to a temperature of from about 150° C. to about 500° C.;

(c) injecting an oxygenated organic hydrocarbon compound and water into the in-situ reaction zone;

(d) reacting the oxygenated organic hydrocarbon compound in the in-situ reaction zone to produce hydrogen and other cracking products;

(e) hydrogenating crude oil in the in-situ reaction zone in the presence of the hydrogen produced to form a hydrogenation reaction product; and (f) recovering a hydrocarbon material from the crude oil reservoir including at least some of the hydrogenation reaction product and crude oil.

18. The method of claim 17 wherein the oxygenated organic hydrocarbon compound is selected from the group of compounds consisting of ethers, ketones, alcohols, aldehydes, glycols, carbohydrates and mixtures thereof.

19. The method of claim 17 wherein the oxygenated organic hydrocarbon compound includes at least one alcohol.

20. The method of claim 19 wherein the at least one alcohol is selected from the group consisting of methanol, ethanol and a mixture thereof.

* * * * *